US007876233B2

(12) United States Patent
Dawson et al.

(10) Patent No.: US 7,876,233 B2
(45) Date of Patent: Jan. 25, 2011

(54) METHOD TO PROVIDE INTELLIGENT LIGHTING FOR LOCATING AN ERROR CONDITION OF A COMPUTER RESOURCE

(75) Inventors: Christopher J. Dawson, Arlington, VA (US); Vincenzo V. Diluoffo, Sandy Hook, CT (US); Rick A. Hamilton, II, Charlottesville, VA (US); Michael D. Kendzierski, New York, NY (US)

(73) Assignee: International Business Machines Corporation, Armonk, NY (US)

( * ) Notice: Subject to any disclaimer, the term of this patent is extended or adjusted under 35 U.S.C. 154(b) by 325 days.

(21) Appl. No.: 12/140,399

(22) Filed: Jun. 17, 2008

(65) Prior Publication Data

US 2009/0309716 A1 Dec. 17, 2009

(51) Int. Cl.
*G08B 5/00* (2006.01)

(52) U.S. Cl. ..... 340/815.4; 340/691.1

(58) Field of Classification Search ..... 340/540, 340/635, 691.1, 815.4; 307/38–42; 700/90
See application file for complete search history.

(56) References Cited

U.S. PATENT DOCUMENTS

| | | | |
|---|---|---|---|
| 6,150,943 | A | 11/2000 | Lehman et al. |
| 6,867,704 | B2 | 3/2005 | Pellegrino |
| 7,026,947 | B2 | 4/2006 | Faltesek et al. |
| 7,161,495 | B1 | 1/2007 | Kilbourne, II et al. |
| 7,199,724 | B2 | 4/2007 | Danvir et al. |
| 7,221,110 | B2 | 5/2007 | Sears et al. |
| 7,333,000 | B2 | 2/2008 | Vassallo |
| 2008/0071391 | A1 | 3/2008 | Busby et al. |

FOREIGN PATENT DOCUMENTS

| | | |
|---|---|---|
| WO | WO9516249 | 6/1995 |

*Primary Examiner*—Jeffery Hofsass
(74) *Attorney, Agent, or Firm*—Suiter Swantz pc llo

(57) ABSTRACT

The present disclosure is a system and method to control illumination within a data center, so as to efficiently light areas only when necessary. A path of low level light created between the entrance of the data center and the location of the required machine to access may be provided.

1 Claim, 3 Drawing Sheets

METHOD TO PROVIDE INTELLIGENT LIGHTING FOR LOCATING AN ERROR CONDITION OF A COMPUTER RESOURCE

TECHNICAL FIELD

The present disclosure generally relates to the field of data center management, and more particularly to a system and method to provide intelligent lighting.

BACKGROUND

Data centers require and consume a large amount of power. A substantial amount of power is directed to powering computing resources of a data center. Additionally, a substantial amount of power is also directed to lighting and ventilation of a data center. Power consumption significantly adds to an overall cost of maintaining a data center.

SUMMARY

The present disclosure is directed to a system and method to provide intelligent lighting. An intelligent lighting system may operate with the computing resources of a data center and a lighting system of a data center to properly control lighting of the data center. Areas of a data center may be illuminated only when necessary. For example, when maintenance is necessary for a computing resource, low level lighting may be supplied to direct a user to the location of the computing resource and the particular area of the computing resource may be illuminated.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings.

Figure 1:
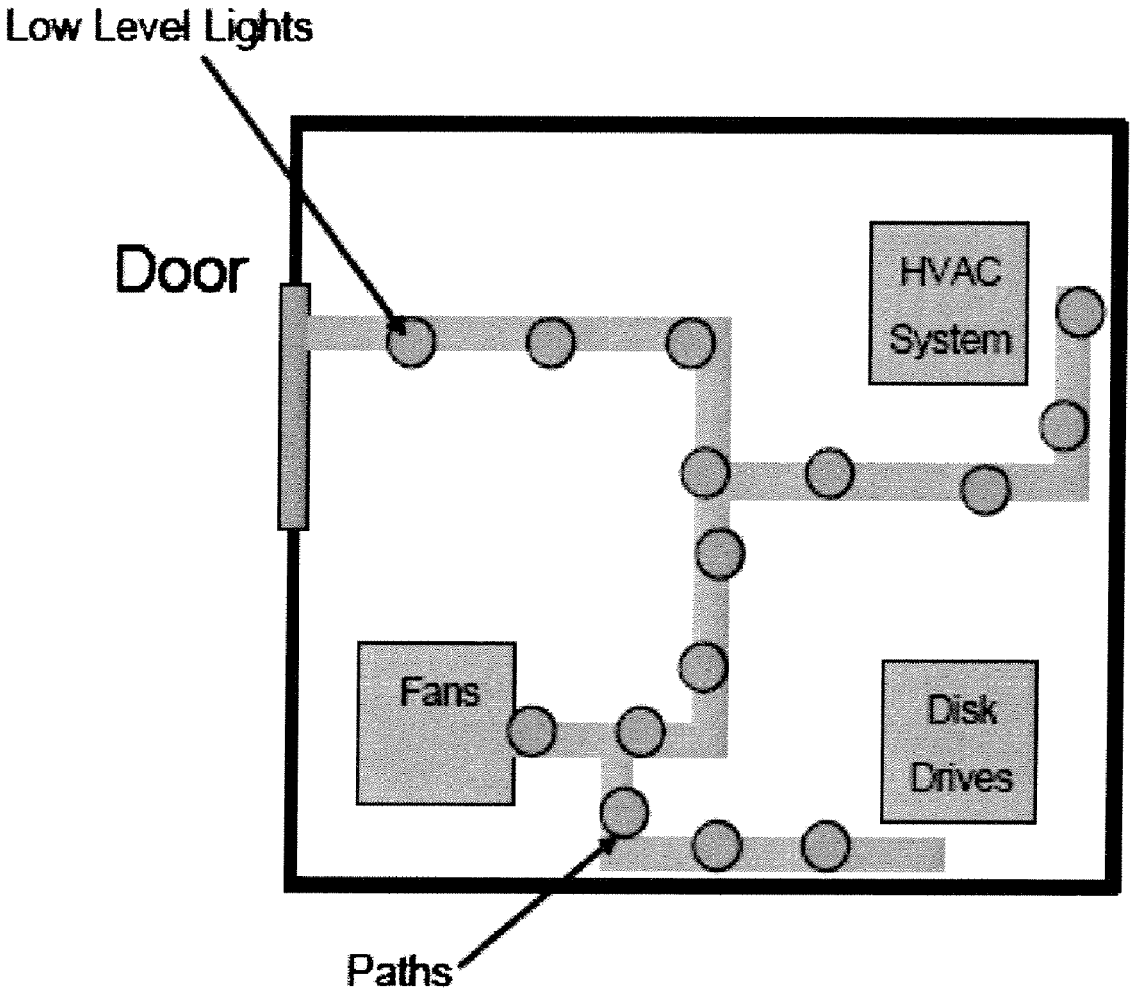
FIG. 1 is a diagram illustrating a data center.

Referring to FIG. 1, a diagram illustrating a data center is shown. An arrangement of paths, low level lighting and information technology (IT) infrastructure including HVAC system, fans and disk drives may be employed within a data center. Along each of the paths, low level lighting may be embedded in the floor. The lights may be switched on and off by a central lighting system that may be controlled by a lighting control system. Such illumination may be immediate, or it may require subsequent invocation of the already-chosen route by arriving maintenance personnel.

Figure 2:
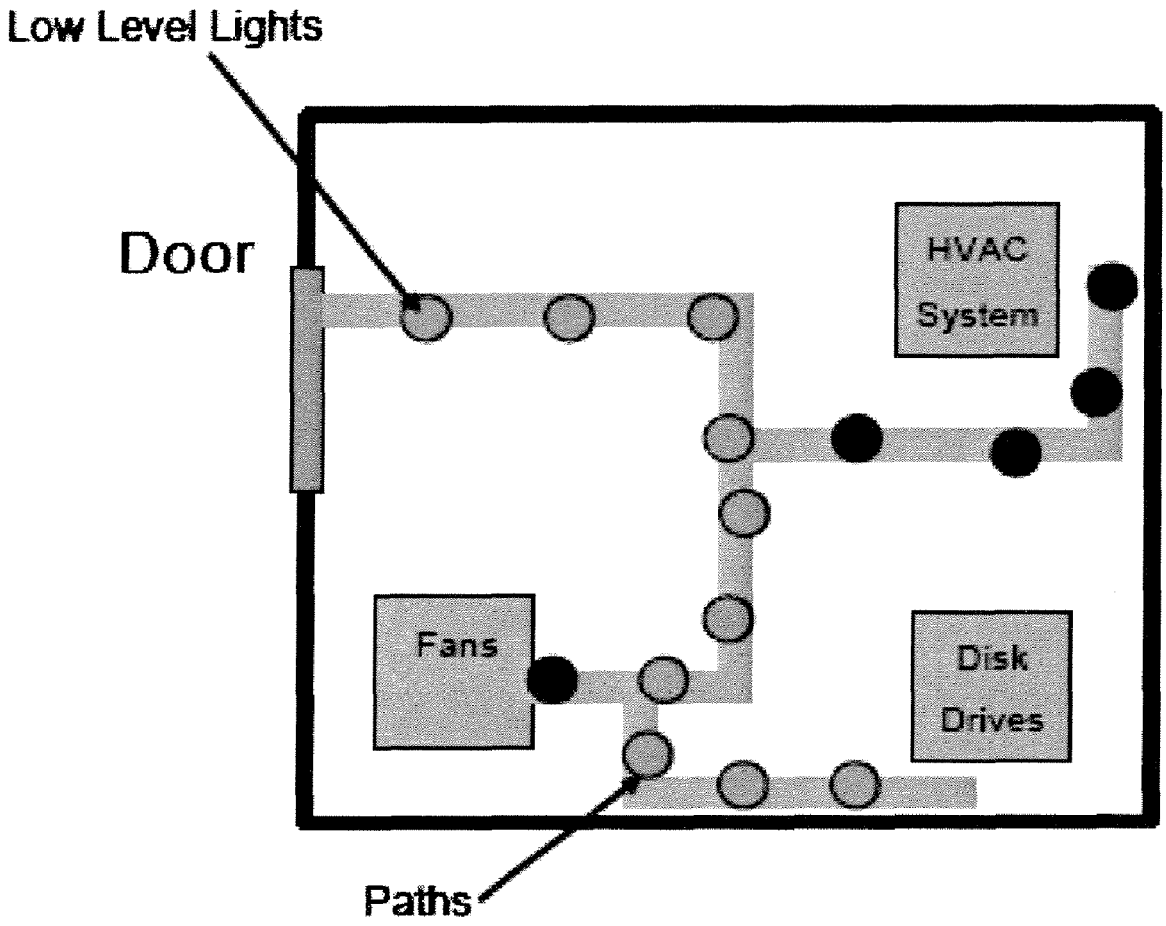
FIG. 2 is a diagram illustrating a data center.

For example, assume that no computers within the data center are experiencing problems. All of the low level lighting may be switched off. Assume that the Disk Drives suddenly detect a problem such as 'RAID 5 array corrupted.' In this example, the failing device may send an alert to a known art monitoring system. A lighting control system may also receive the alert. The lighting control system may determine a location of the failed device and may plot a path from an entrance of the data center to the disk drives. An example of this is shown in FIG. 2, depicting a lit route from the entrance of the data center to the disk drives.

An administrator may enter the data center to resolve the problem and may be able to take the fastest route to the disk drives. An administrator may be required to perform standard maintenance. An administrator may access the lighting control system—by use of a console or client/server interaction (for example, a web browser) and may request lighting to the required computers. The administrator may manually enter or otherwise select the computer(s) that need attention. The system then determines the location of the computer system and calculates the quickest (or shortest) route to that computer. The route is then illuminated through the use of low level lighting. This lighting may include arrows, colors or other visual notifications to assist the administrator plot routes. Different colors may be used to notify different administrators. Similarly, a focused light, such as a spotlight and the like, may be used to illuminate the particular computing resource that requires access. Sound may also be used to help an administrator walk along a path in the dark. The intensity of the lights may get stronger when the administrator nears the computer that needs attention.

A computer or other device may store a location of all, or some plurality of, IT infrastructure within the data center. This may be in the form of a database with the name, description and coordinates within the data center. This lighting system also stores all of the pathways and routes within the data center that a system administrator is able to walk. This centralized lighting system may be coupled with a lighting control system that may be physically located near the entrance to the data center (similar to a console) or be running on a computer server accessible by a system administrator in a client/server manner. An example may be a web server that the administrator can access at his or her desk (or at home) before traveling to the data center.

The lighting control system may also provide an ability for an administrator to register themselves such that if a specific computer detects a problem, a route to the computer may be automatically lighted such that an administrator can access the computer with minimal wasted searching. Each computer within the data center that is able to self detect possible errors should be able to flag the problem to the centralized lighting system. This may be in the form (but not limited to) SNMP traps, email, XML messaging or similar. This communication may be via a standard hard wired network (such as Ethernet), Wireless or other known art method.

It is contemplated that the data center does not need to be constantly illuminated. A 'lights out' approach to the data center using the lighting control system may employ 'low level' lighting—either lighting embedded in the paths around the data center (similar to LED lights using in emergency lighting in airplanes), in the walls, or overhead. Routes may be automatically it between the entrance to the data center and the location (s) of computing resources that may require attention. By pre-lighting the route from the data center entrance to the affected computer, administrators can quickly and easily find the problem computer system and quickly diagnose the problem.

Figure 3:
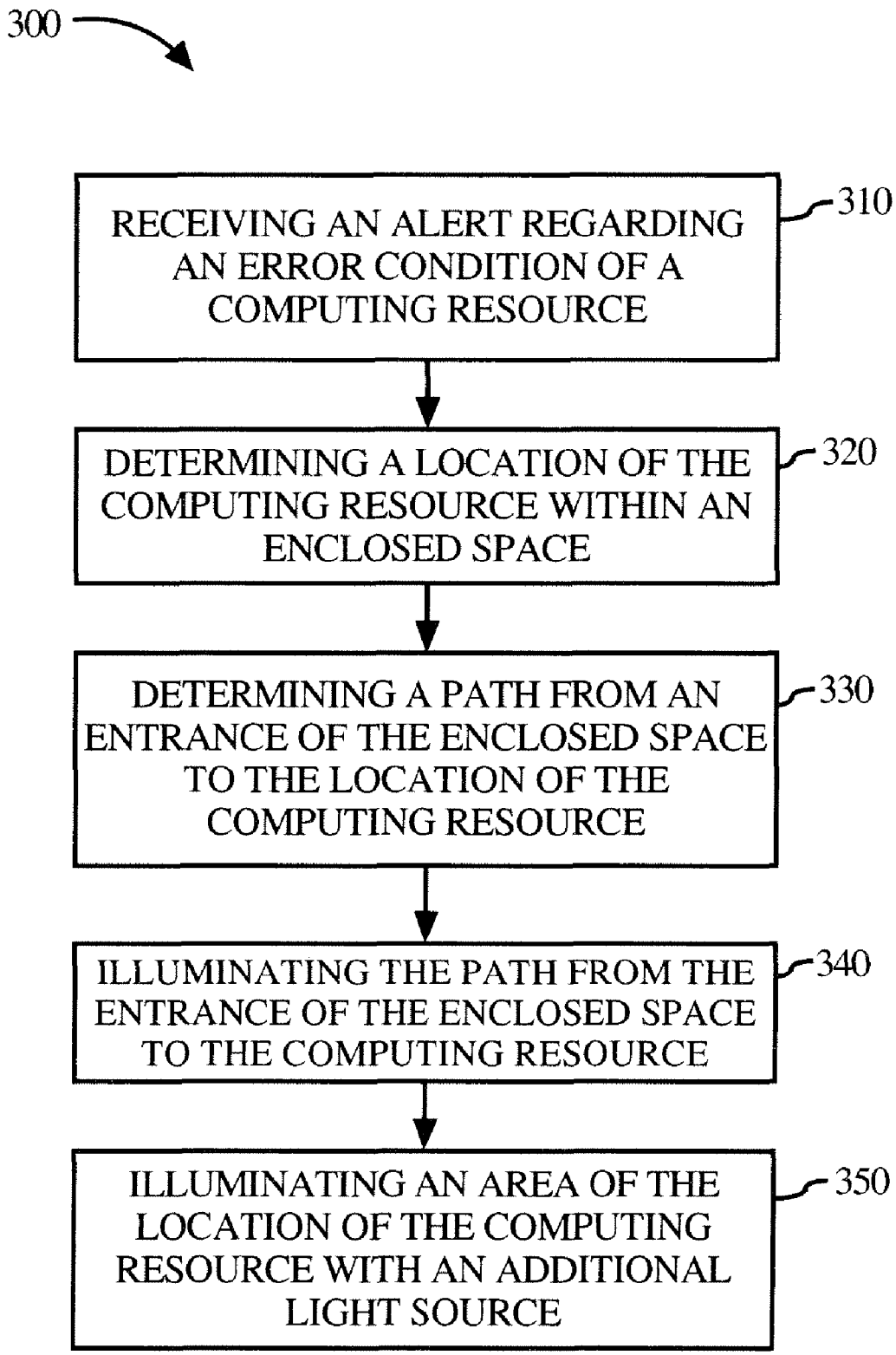
FIG. 3 is a flow diagram illustrating a method for providing lighting.

Referring to FIG. 3, flow diagram illustrating a method 300 for providing lighting is shown. Method 300 may include receiving an alert regarding an error condition of a computing resource 310. A computing resource may be any type of computing equipment, including a server, a disk drive and the like. Method 300 may include determining a location of the computing resource within an enclosed space. An enclosed space may refer to a room, floor and the like 320. Method 300 may include determining a path from an entrance of the enclosed space to the location of the computing resource 330. Method 300 may include illuminating the path from the entrance of the enclosed space to the location of the computing resource 340. It is contemplated that the path may be lit with low level lighting, such as light emitting diodes. Method 300 may include illuminating an area of the location of the computing resource with an additional light source 350.

Energy may be conserved in lighting the entire data center. System administrators are able to quickly and efficiently have a route to a computer lit by low level lighting. This provides an optimal route to the computer whilst reducing the possible error of the administrator accessing the wrong system. The ability for computers to identify themselves to the lighting system and automatically signal detected errors improves the time taken to resolve the incident.

It should be noted that "low level lighting" can refer to any of several options, each of which consumes less power than legacy lighting systems. These may include, low intensity lighting, standard lighting which is employed only "as needed," or even brighter illumination issuing forth from focal centralized focal points (e.g., upon a swivel). Again, the point of commonality is that each option consumes less power than legacy mechanisms, and is responsive to service needs across the data center.

In the present disclosure, the methods disclosed may be implemented as sets of instructions or software readable by a device. Further, it is understood that the specific order or hierarchy of steps in the methods disclosed are examples of exemplary approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. A method for controlling illumination, comprising:

receiving an alert regarding an error condition of a computing resource;

determining a location of said computing resource within an enclosed space;

determining a path from an entrance of said enclosed space to said location of said computing resource;

illuminating said path from said entrance of said enclosed space to said location of said computing resource; and illuminating an area of said location of said computing resource with an additional light source.

* * * * *